US007683547B2

(12) United States Patent
Aizawa

(10) Patent No.: US 7,683,547 B2
(45) Date of Patent: Mar. 23, 2010

(54) METHOD FOR LIGHTING FLAT FLUORESCENT LAMP

(75) Inventor: Masanobu Aizawa, Yokohama (JP)

(73) Assignee: LG Display Co., Ltd., Seoul (KR)

( * ) Notice: Subject to any disclaimer, the term of this patent is extended or adjusted under 35 U.S.C. 154(b) by 329 days.

(21) Appl. No.: 10/550,739

(22) PCT Filed: Jan. 26, 2005

(86) PCT No.: PCT/JP2005/001004

§ 371 (c)(1),
(2), (4) Date: Mar. 22, 2007

(87) PCT Pub. No.: WO2005/072022

PCT Pub. Date: Aug. 4, 2005

(65) Prior Publication Data

US 2008/0018258 A1 Jan. 24, 2008

(30) Foreign Application Priority Data

Jan. 26, 2004 (JP) ..... 2004-047085

(51) Int. Cl.
*H01J 17/04* (2006.01)

(52) U.S. Cl. ..... 313/627; 313/634; 313/637; 313/241; 313/547; 315/46; 315/97; 315/105; 315/112

(58) Field of Classification Search ..... 349/149–152; 313/495, 496, 500, 511, 499, 422, 493, 643, 313/609–612, 44; 315/46–49, 105–107, 315/94, 97, 99, 112–118

See application file for complete search history.

(56) References Cited

U.S. PATENT DOCUMENTS

| | | | | |
|---|---|---|---|---|
| 5,387,921 | A * | 2/1995 | Zhang et al. | 345/102 |
| 5,808,418 | A | 9/1998 | Pitman | |
| 6,127,780 | A | 10/2000 | Winsor | |
| 6,294,867 | B1 | 9/2001 | Lynn | |
| 6,545,410 | B1 * | 4/2003 | Wu et al. | 313/582 |
| 2001/0033483 | A1 | 10/2001 | Moore | |

FOREIGN PATENT DOCUMENTS

| | | |
|---|---|---|
| EP | 1 351 275 | 10/2003 |
| JP | 1-75958 | 5/1969 |
| JP | 56-077725 | 6/1981 |
| JP | 56-129063 | 10/1981 |
| JP | 5-503607 | 6/1993 |
| JP | 5-182638 | 7/1993 |
| JP | 8-273603 A | 10/1996 |

(Continued)

*Primary Examiner*—Tuyet Vo
(74) *Attorney, Agent, or Firm*—McKenna Long & Aldridge LLP

(57) ABSTRACT

A method for lighting a flat fluorescent lamp for a large-sized backlight unit is disclosed, to prevent a discharge interference (scattering in fluorescent discharge) when lighting a plurality of groups of cylindrical electrodes being adjacent, in which an A.C. voltage is applied to one or two groups of cylindrical electrodes through introduction wires for lighting lamp in state of being not applied to adjacent one or two groups of cylindrical electrodes, so the plurality of groups of cylindrical electrodes are sequentially switched on and off in a time-division method at a speed not to generate the flicker of lamp.

1 Claim, 1 Drawing Sheet

FOREIGN PATENT DOCUMENTS

| | | |
|---|---|---|
| JP | 63-80461 A | 4/1998 |
| JP | 2002-190276 | 7/2002 |
| JP | 2004-134410 | 4/2004 |
| JP | 2004-152775 | 5/2004 |
| JP | 2004-158458 | 6/2004 |
| WO | WO 92/02947 | 2/1992 |

* cited by examiner

METHOD FOR LIGHTING FLAT FLUORESCENT LAMP

This application is a 35 U.S.C. §371 National Stage entry of International Application No. PCT/JP05/01004, filed on Jan. 26, 2005, and claims priority to Japan Patent Application No. 2004-47085, filed on Jan. 26, 2004.

TECHNICAL FIELD

The present invention relates to a method for lighting a flat fluorescent lamp, in which the flat fluorescent lamp is provided and illuminated in a rear surface of an LCD device, to obtain the brightness in a display surface of the LCD device, and more particularly, to a method for lighting a flat fluorescent lamp of a large-sized backlight suitable for a large-sized liquid crystal television.

BACKGROUND ART

In general, a backlight unit is comprised of a plurality of cold cathode fluorescent lamps and a light-guiding plate of acrylate. However, the backlight unit may have the following disadvantages such as the loss of light due to the light-guiding plate and the increasing number of cold cathode fluorescent lamps according to the large-sized LCD device.

As disclosed in patent documents 1, 2 and 3, a flat fluorescent lamp is formed of one lamp, which functions as a backlight. The flat fluorescent lamp is very useful for a large-sized backlight unit in that it can be resistant to an external air pressure in a large size, it can obtain a uniform surface luminance, and it can be illuminated brightly even at a low temperature. In this flat fluorescent lamp having a plurality of groups of electrodes, a lighting method is the problem which confronts us.

Patent Document 1: Patent Application No. 2003-436375
Patent Document 2: Patent Application No. 2003-428313
Patent Document 3: Patent Application No. 2003-420114

DISCLOSURE OF THE INVENTION

Accordingly, the present invention is directed to a method for lighting a flat fluorescent lamp that substantially obviates one or more problems due to limitations and disadvantages of the related art.

An object of the present invention is to provide a method for lighting a flat fluorescent lamp to prevent the discharge interference (dispersing in fluorescent discharge) between adjacent groups of cylindrical electrodes when lighting the plurality of groups of cylindrical electrodes through introduction wires by applying a voltage.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, in a method for lighting a flat fluorescent lamp, the flat fluorescent lamp includes a front glass substrate provided with a plurality of grooves formed in the predetermined portions except the circumference of the front glass substrate and the portion for forming members such as cylindrical electrodes, and a fluorescent substance coating film formed on the inner surface of the front glass substrate except the circumference; a rear glass substrate provided with the plurality of grooves formed in the predetermined portions except the circumference of the rear glass substrate and the portion for forming members such as the cylindrical electrodes, and a fluorescent substance coating film formed on the inner surface of the rear glass substrate except the circumference; and a sealed body formed by welding the circumference of the front and rear glass substrates in state of being inserted to a glass frame having an exhaust pipe after coupling the front and rear glass substrates, on providing the sealed body, an exhaust pipe is formed to the upper side of the glass frame, a plurality of introduction wires for lighting lamp being welded to a plurality of groups of cylindrical electrodes are formed to the both lateral sides of the glass frame, and introduction wires for a heater, connected with a heater wires and a plate-type spring, are formed to the lower side of the glass frame.

To realize the method for lighting the flat fluorescent lamp for preventing the discharge interference (dispersing in fluorescent discharge) between adjacent groups of cylindrical electrodes, an A.C. voltage is applied to one or two groups of cylindrical electrodes through the introduction wires for lighting lamp in state of being not applied to adjacent one or two groups of cylindrical electrodes, so the plurality of groups of cylindrical electrodes are sequentially switched on and off in a time-division method at a speed not to generate the flicker of lamp.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Figure 1:
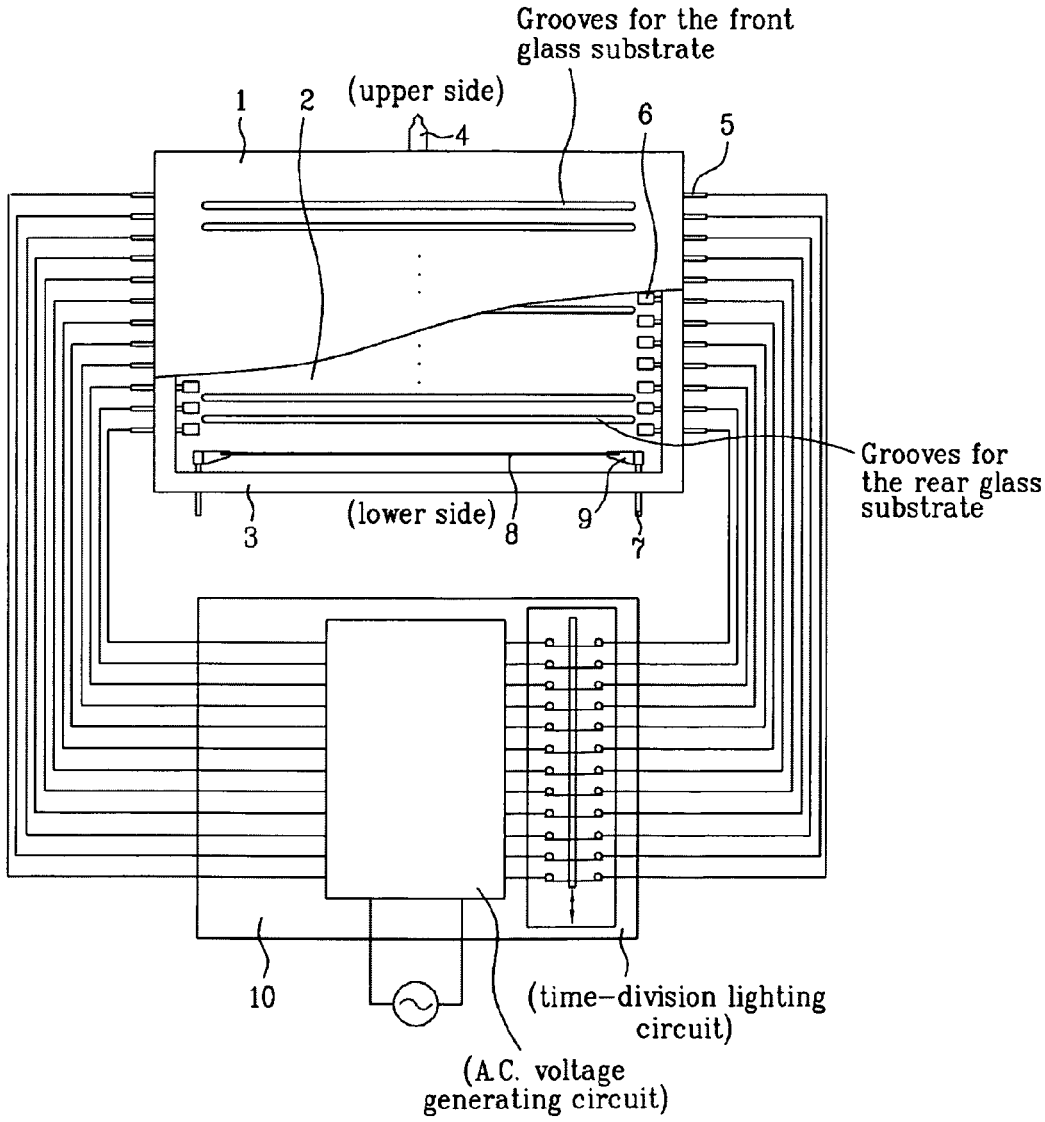
FIG. 1 illustrates a method for lighting a flat fluorescent lamp according to the preferred embodiment of the present invention.

Reference will now be made in detail to the preferred embodiments of the present invention, examples of which are illustrated in the accompanying drawings. Wherever possible, the same reference numbers will be used throughout the drawings to refer to the same or like parts.

Hereinafter, a method for lighting a flat type fluorescent lamp according to the preferred embodiment of the present invention will be described with reference to the accompanying drawings.

FIG. 1 illustrates a method for lighting a flat fluorescent lamp according to the preferred embodiment of the present invention.

Referring to FIG. 1, a flat type fluorescent lamp according to the preferred embodiment of the present invention is provided with a front glass substrate of a rectangular shape and a rear glass substrate of a rectangular shape, wherein the front glass substrate 1 is coupled with the rear glass substrate 2.

Then, the coupled front and rear glass substrates 1 and 2 are inserted to a glass frame 3, wherein members such as exhaust pipe is provided to the glass frame. As a result, it is possible to form a sealed body with the front and rear glass substrates and the glass frame.

Specifically, the front glass substrate 1 is provided with a plurality of rows of grooves for reinforcement of the glass substrates. At this time, the grooves are formed in the predetermined portions except the circumference of the front glass substrate and the portion for forming members such as cylindrical electrodes. Also, a fluorescent substance (not shown) is coated on the inner surface of the front glass substrate except the circumference.

The rear glass substrate 2 is provided with a plurality of rows of grooves in parallel. At this time, the grooves are formed in the predetermined portions except the circumference of the rear glass substrate and the portion for forming members such as the cylindrical electrodes. Also, a fluorescent substance (not shown) is coated on the inner surface of the rear glass substrate except the circumference.

When the sealed body is provided in state of positioning the grooves in horizontal, an exhaust pipe 4 is provided in an upper side of the glass frame 3. Also, a plurality of introduction wires for lighting the lamp 5 are provided to the both lateral sides of the glass frame 3, wherein a plurality of groups of cylindrical electrodes 6 are welded to the introduction wires for lighting the lamp 5. Then, a heater wire 8 and a plate-type spring 9 are provided in the lower side of the glass frame 3, wherein introduction wires for heater 7 are connected with the heater wire 8 and the plate-type spring 9.

In the aforementioned flat fluorescent lamp according to the preferred embodiment of the present invention, an A.C. voltage is applied to the plurality of groups of cylindrical electrodes 6 through the introduction wires for lighting the lamp 5 from a lighting system 10, whereby the groups of cylindrical electrodes 6 are in the switching-on state. In state of providing the A.C. voltage to one or two groups of cylindrical electrodes, the A.C. voltage is not applied to adjacent one or two groups of cylindrical electrodes, whereby the adjacent one or two groups of cylindrical electrodes are maintained in the turning-off state. As a result, the plurality of groups of cylindrical electrodes are sequentially switched on and off in a time-division method at a speed not to generate the flicker of lamp, so that it is possible to prevent the discharge interference between the adjacent groups of cylindrical electrodes. Also, the frequency of the A.C. voltage for switching-on the lamp is about 50 KHz. For example, the plurality of groups of cylindrical electrodes are sequentially switched on and off at a speed of about 100 Hz, thereby preventing the flicker in the luminance of the LCD device.

FIG. 1 illustrates the lighting system 10 in the lighting method of the flat fluorescent lamp according to the preferred embodiment of the present invention, wherein the lighting system 10 includes an A.C. voltage generating circuit and a time-division lighting circuit. That is, the A.C. voltage is applied to the plurality of groups of the cylindrical electrodes 6 through the introduction wires for lighting the lamp 5 in the time-division method. Under control of the lighting system 10, the A.C. voltage is applied to one group of cylindrical electrodes from the time-division lighting circuit in state of being not applied to the adjacent group of cylindrical electrodes. According to the time-division method, one group of cylindrical electrodes is in the switching-on state, and the adjacent one group of cylindrical electrodes is in the switching-off state in the speed not to generate the flicker.

INDUSTRIAL APPLICABILITY

Accordingly, the method for lighting the flat fluorescent lamp according to the present invention has the following advantages.

As the competition in development for the LCD device becomes keen in Korea, Japan and Taiwan, the industry fields of the LCD device and the backlight unit have been developed and researched actively. The method for lighting the flat fluorescent lamp according to the present invention is very useful in many ways.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for lighting a flat fluorescent lamp, the flat fluorescent lamp including a front glass substrate provided with a plurality of grooves formed in portions except the circumference of the front glass substrate and a part for forming members including cylindrical electrodes, and a fluorescent substance coating film formed on the inner surface of the front glass substrate except the circumference; a rear glass substrate provided with the plurality of grooves formed in portions except the circumference of the rear glass substrate and the part for forming members including the cylindrical electrodes, and a fluorescent substance coating film formed on the inner surface of the rear glass substrate except the circumference; and a sealed body formed by welding the circumference of the front and rear glass substrates in state of being inserted to a glass frame having an exhaust pipe after coupling the front and rear glass substrates, on providing the sealed body, an exhaust pipe is formed to the upper side of the glass frame, a plurality of introduction wires for lighting lamp being welded to a plurality of groups of cylindrical electrodes are formed to the both lateral sides of the glass frame, and introduction wires for a heater, connected with a heater wires and a plate-type spring, are formed to the lower side of the glass frame, wherein, an A.C. voltage is applied to one or two groups of cylindrical electrodes 6 through the introduction wires for lighting lamp 5 in state of being not applied to adjacent one or two groups of cylindrical electrodes 6, 50 the plurality of groups of cylindrical electrodes are sequentially switched on and off in a time-division method at a speed not to generate the flicker of lamp.

* * * * *